US007410228B2

(12) United States Patent
Dickson et al.

(10) Patent No.: US 7,410,228 B2
(45) Date of Patent: Aug. 12, 2008

(54) HEIGHT ADJUSTER MECHANISM FOR A DISHWASHER DISH RACK

(75) Inventors: Harry W. Dickson, Jackson, TN (US); Kory A. Gunnerson, West Lafayette, IN (US); Kristen K. Hedstrom, Orlando, FL (US); Mark E. Palm, Orlando, FL (US); Michael C. Simmons, Moscow, TN (US); Daniel R. Teteak, Des Moines, IA (US); Chad M. Thomas, Cookeville, TN (US); Wayne M. VanLandingham, Texarkana, TX (US); Rodney M. Welch, Jackson, TN (US); Karl R. C. Wendt, Des Moines, IA (US); Jeffrey N. Williams, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 484 days.

(21) Appl. No.: 11/006,610

(22) Filed: Dec. 8, 2004

(65) Prior Publication Data

US 2006/0119236 A1 Jun. 8, 2006

(51) Int. Cl.
*A47B 88/00* (2006.01)

(52) U.S. Cl. ..... 312/311; 312/351; 211/41.9

(58) Field of Classification Search ..... 312/334.4, 312/311, 350–351, 228.1, 333, 236, 215, 312/222; 134/137, 58 D, 200–201; 211/41.8, 211/41.9, 175, 181.1, 207–208
See application file for complete search history.

(56) References Cited

U.S. PATENT DOCUMENTS 3,466,109 A 9/1969 Kauffman et al.
3,486,804 A 12/1969 Kaufman et al.
3,726,580 A * 4/1973 Guth ..... 312/351
3,734,589 A 5/1973 Morgan
3,736,037 A * 5/1973 Doepke ..... 312/351
3,809,450 A * 5/1974 Guth ..... 312/351
3,822,085 A * 7/1974 Clark ..... 312/351
3,892,453 A * 7/1975 Daily ..... 312/351
4,097,099 A 6/1978 Spiegel
5,474,378 A 12/1995 Smith et al.
5,595,200 A 1/1997 Favaro
5,657,878 A 8/1997 Austin
5,860,716 A 1/1999 Good et al.

(Continued)

FOREIGN PATENT DOCUMENTS

DE 4227585 * 2/1994

(Continued)

*Primary Examiner*—Lanna Mai
*Assistant Examiner*—Hanh V Tran
(74) *Attorney, Agent, or Firm*—John Morrison; Michael D. Lafrenz

(57) ABSTRACT

A vertical height adjustment mechanism for a dish rack includes a slide member fixedly mounted relative to a support member, a housing secured to the dish rack, and a latch member. The housing includes a central guide channel that slidably receives the slide member. The latch member includes a support leg, an actuating arm and an intermediate portion joining the support leg and actuating arm. The sliding element includes an end portion that receives and retains the support leg of the latch when the dish rack is in the raised position.

35 Claims, 15 Drawing Sheets

U.S. PATENT DOCUMENTS

| | | | | |
|---|---|---|---|---|
| 7,168,578 | B2 * | 1/2007 | Mersch et al. | 211/41.8 |
| 2003/0042825 | A1 | 3/2003 | Welch et al. | |
| 2003/0075517 | A1 | 4/2003 | Jahrling | |
| 2003/0226580 | A1 * | 12/2003 | Welch | 134/172 |
| 2004/0103932 | A1 * | 6/2004 | Kim | 134/137 |

FOREIGN PATENT DOCUMENTS

| | | | |
|---|---|---|---|
| DE | 4228954 | * | 3/1994 |
| DE | 19512128 | * | 10/1998 |
| DE | 19926962 | * | 12/1999 |
| DE | 10120577 | * | 10/2002 |
| EP | 0 033 483 | A2 | 8/1981 |
| EP | 0 848 930 | A2 | 12/1997 |
| EP | 1 166 708 | A2 | 1/2001 |
| EP | 1 161 917 | A2 | 12/2001 |

* cited by examiner

HEIGHT ADJUSTER MECHANISM FOR A DISHWASHER DISH RACK

BACKGROUND OF THE INVENTION

1. Field of the Invention

The present invention pertains to the art of dishwashers and, more particularly, to a vertical height adjuster mechanism for a dishwasher dish rack.

2. Discussion of the Prior Art

A front loading dishwasher typically includes a tub having an open front. The tub defines a washing chamber into which items, such as kitchenware, glassware and the like, are placed to undergo a washing operation. The dishwasher is generally provided with a door, pivotally mounted to the tub, that closes the open front, and upper and lower extensible dish racks for supporting items during the washing operation. Typically, the upper and lower dish racks are separated by a defined vertical spacing that limits the overall size of items that can be placed in the dishwasher.

In order to provide more flexibility to consumers, manufacturers have developed adjustment mechanisms that enable the dish rack to be vertically adjustable. That is, the dish rack can be vertically shifted to increase the defined vertical spacing between the upper and lower dish racks. Typically, the adjustment mechanisms are mounted on opposing sides of the dish rack and connect to extensible support rails that permit the dish rack to move in and out of the washing chamber. In most cases, the adjustment mechanisms have complicated structure including ratchet and pawl elements that make up latch/release and support portions of the adjustment mechanism. Over time, the ratchet and pawls will wear and require service and/or replacement. Furthermore, the complicated structure used in many prior art adjustment mechanisms adds to the overall manufacturing costs in that separate components are required for each side of the dish rack.

In addition to increasing service and manufacturing costs, the latching mechanisms used by prior art adjustment mechanisms can be difficult to operate. Hidden buttons, sticky latches, and the like can make it difficult to transition from one height position to another. In some cases, the adjustment mechanisms are unstable. That is, when in a raised position, the adjustment mechanism creates a moment arm that will limit the size/weight of items placed on the dish rack.

Based on the above, there still exists a need in the art for a vertical height adjustment mechanism for a dishwasher dish rack. More specifically, there exists a need for a vertical height adjustment mechanism that is simple to manufacture, easy to use and provides support in all height positions.

SUMMARY OF THE INVENTION

The present invention is directed to a dishwasher including an open front tub that defines a washing chamber, a door pivotally mounted relative to the tub for closing the washing chamber and a dish rack for supporting items to be washed in the washing chamber. The dish rack is mounted to horizontally extensible support members that permit the dish rack to be horizontally shifted in and out of the washing chamber. Preferably, the dish rack is provided with an adjustment mechanism that enables the dish rack to also be vertically shifted between first and second positions.

In accordance with a preferred form of the invention, the adjustment mechanism includes a slide member fixedly mounted relative to the support members, a housing secured to the dish rack, and a generally L-shaped latch member. In the most preferred form of the invention, the housing includes a central guide channel that slidably receives the slide member. The L-shaped latch member includes a support leg, an actuating arm and an intermediate portion that joins the support leg and actuating arm. More specifically, the intermediate portion includes a hub element for pivotally mounting the latch member relative to the housing. The latch member further includes a spring element that engages with the housing to bias the latch member in a home or lowered position. In accordance with one aspect of the invention, the spring member can be detachably secured to the latch member to allow easy replacement in the event that service is required. Moreover, the latch member preferably includes an integral metal (e.g., steel) core to increase its overall strength and add to the service life.

In accordance with a first embodiment of the present invention, the slide member includes a first end fixedly mounted relative to the support member, a second end for engaging the latch and an intermediate portion. The intermediate portion is generally T-shaped in cross-section and provided with a sliding surface with the second end including a central raised tab element separating two supporting lands. The two supporting lands are provided to engage with the support leg of the latch member (depending on the particular orientation of the adjustment mechanism, e.g., left or right) when the dish rack is in a raised position. The raised tab element prevents the support leg from slipping off the slide member causing the dish rack to fall from the raised position.

In accordance with a second embodiment of the present invention, the intermediate portion of the slide member is generally rectangular or box-shaped in cross-section with the second end being formed with a concave surface that defines a support cup. When the dish rack is shifted to the raised position, the support leg of the latch member rests within the support cup. With this construction, up-turned edge portions, formed with the concave surface, prevent the support leg of the latch from slipping off the support member and inadvertently allowing the dish rack to fall from the raised position. In either case, the slide member can be provided with an integral metal core similar to that described above with respect to the latch member.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
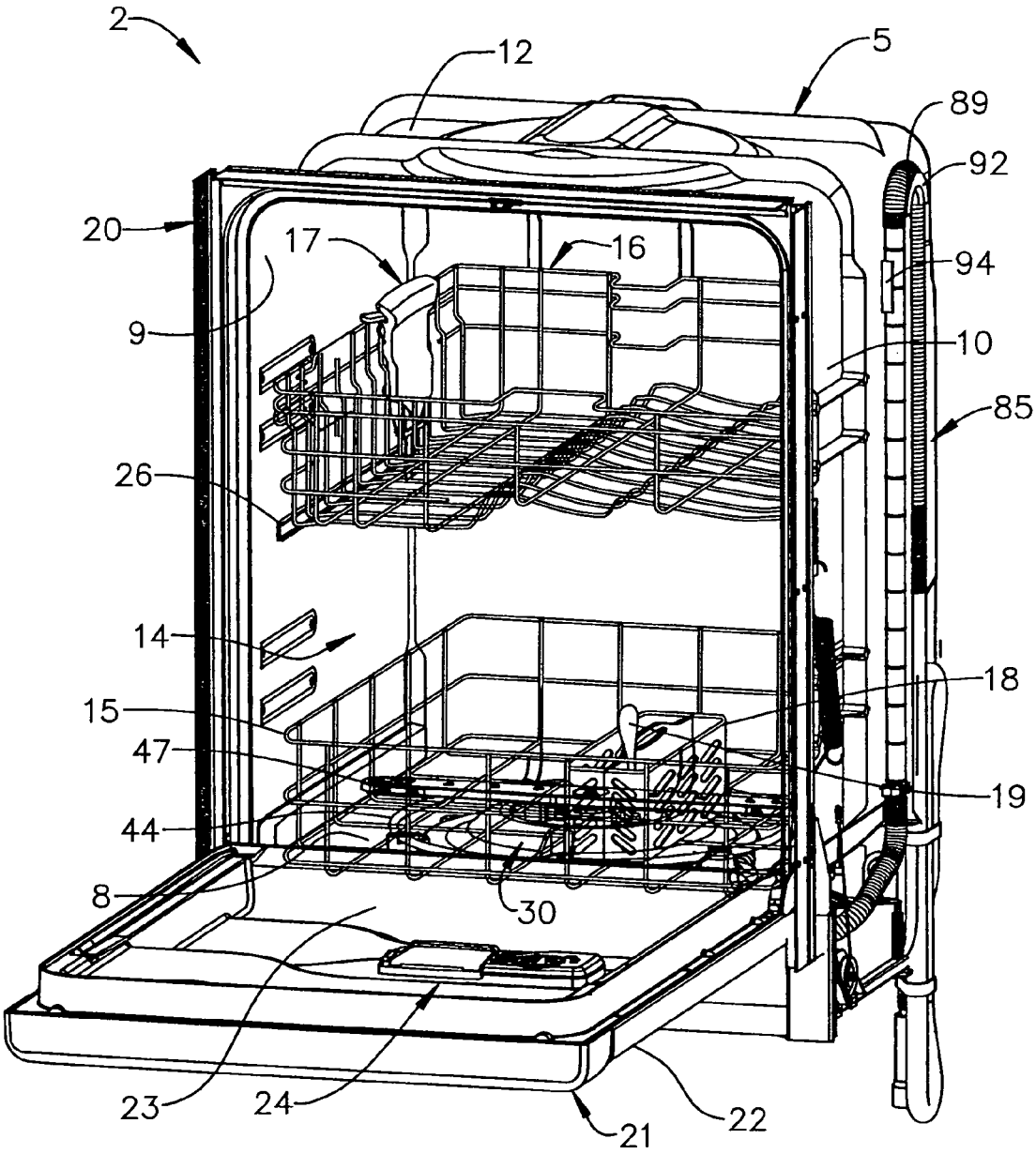
FIG. 1 is a perspective view of a dishwasher incorporating a dish rack having a vertical height adjustment mechanism constructed in accordance with the present invention.
Figure 2:
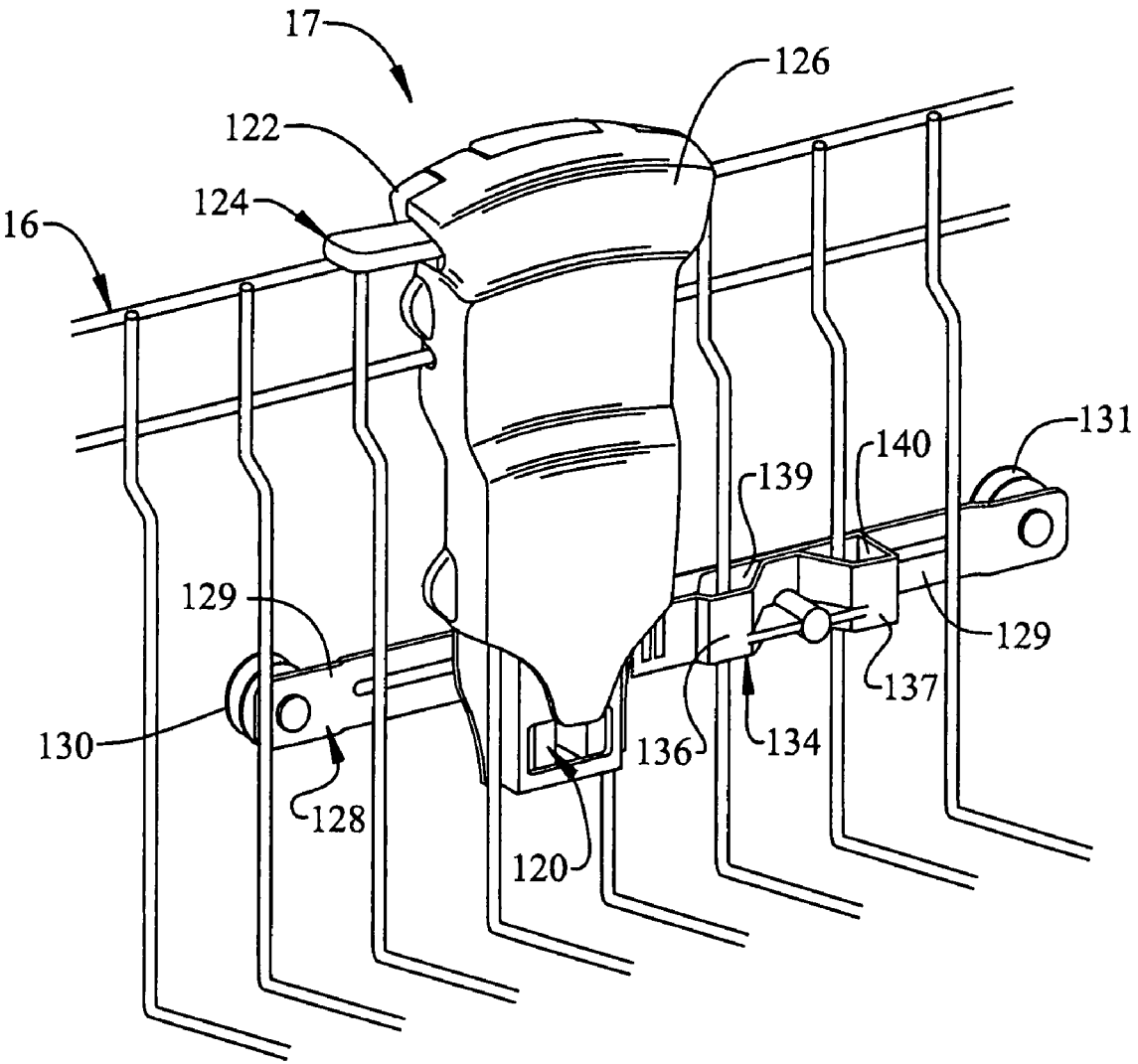
FIG. 2 is a partial perspective view of the dish rack of FIG. 1 including the vertical height adjustment mechanism of the present invention shown in a home or lowered position.
Figure 3:
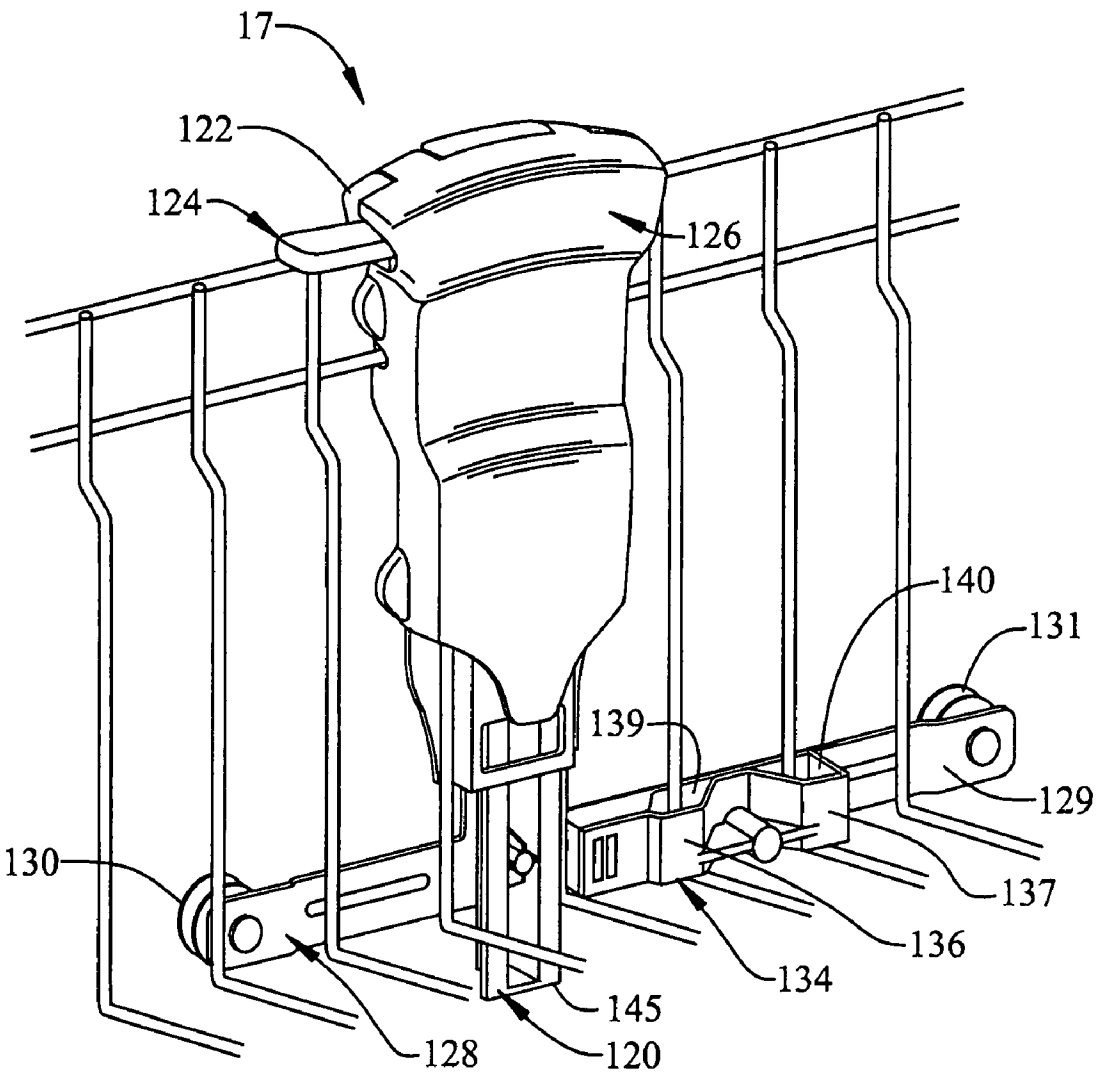
FIG. 3 is a partial perspective view of the dish rack of FIG. 1 including the vertical height adjustment mechanism constructed in accordance with a first embodiment of the present invention shown in raised position.

With initial reference to FIG. 1, a dishwasher constructed in accordance with the present invention is generally indicated at 2. As shown, dishwasher 2 includes a tub 5, which is preferably injection molded of plastic, so as to include integral bottom, side, rear and top walls 8-12 respectively. Within the confines of walls 8-12, tub 5 defines a washing chamber 14 within which soiled kitchenware is adapted to be placed on a lower dish rack 15 and/or an adjustable upper dish rack 16 which, as will be detailed more fully below, includes an adjustment mechanism 17 for vertically shifting dish rack 16 between a first or home position and a second or raised position. As shown in this figure, a utensil basket 18, which contains a utensil 19, is preferably positioned within lower rack 15. Tub 5 has associated therewith a frontal portion 20 at which is pivotally supported a door 21 used to seal washing chamber 14 during a washing operation. Door 21 has an exterior panel 22 and an interior panel 23 preferably provided with a dispensing assembly 24 within which a consumer can place liquid or particulate washing detergent for dispensing at predetermined periods of the washing operation.

In a manner known in the art, upper dish rack 16 is horizontally shiftable between a first position wherein upper dish rack 16 is entirely within the confines of washing chamber 14 and a second position, wherein upper dish rack 16 extends, at least partially outward, from washing chamber 14. Toward that end, dishwasher 2 is provided with extensible support members, one of which is indicated generally at 26. In a similar manner, lower dish rack 15 is selectively, horizontally shiftable between first and second positions. However, when in the second position, lower dish rack 15 rests upon an open door 21 on guide elements (not separately labeled) formed on interior panel 23.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheathed, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, the detailed description of the exact structure and operation of pump and filter assembly 30 of dishwasher 2 does not form part of the present invention, but is rather set forth in pending U.S. application Ser. No. 10/186,739 entitled "Dishwasher Pump and Filtration System" filed Jul. 2, 2002, incorporated herein by reference. Instead, the present invention is directed to particulars of height adjustment mechanism 17.

Reference will now be made to FIGS. 2-7 in describing the particular details of height adjustment mechanism 17. As shown, height adjustment mechanism 17 includes a slide member 120, a housing 122, a generally L-shaped latch member 124 and a cover 126. In accordance with the preferred form of the invention, height adjustment mechanism 17 couples upper dish rack 16 to extensible support member 26. More specifically, a wheeled base member 128, adapted to ride within extensible support member 26, is joined to height adjustment mechanism 17. In the embodiment shown, wheeled base member 128 includes a generally horizontally extending strut member 129 having arranged thereon a pair of wheels 130 and 131 adapted to ride or travel within extensible support member 26. In the most preferred form of the invention, wheeled base member 128 includes a stabilizer member 134 secured to strut member 129. Stabilizer member 134 includes a pair of guide elements 136 and 137 each having an associated central channel 139 and 140 through which passes wire members of upper dish rack 16. With this construction, stabilizer member 134 prevents, or at least substantially eliminates, any cocking when upper dish rack 16 is shifted vertically.

Figure 6:
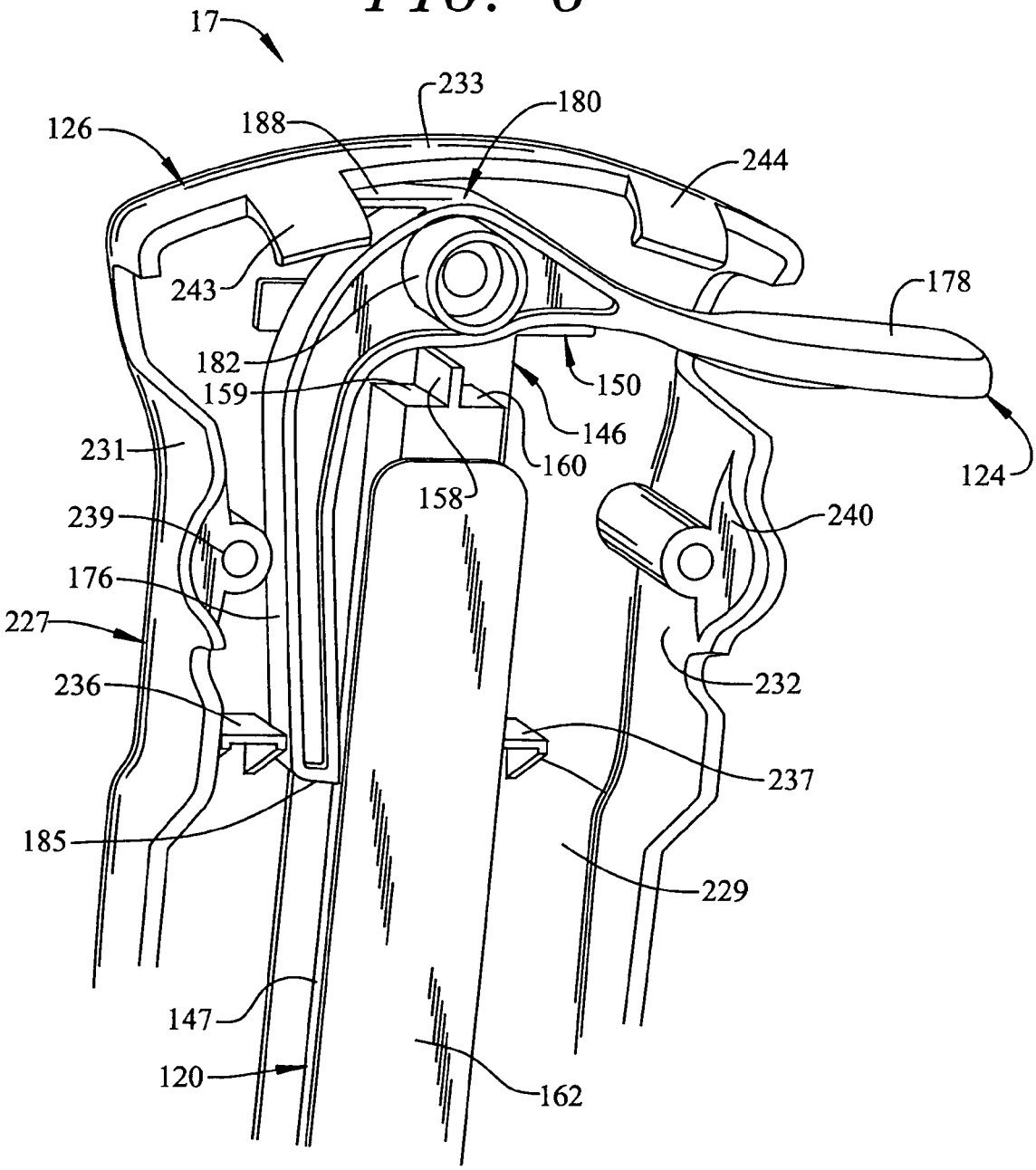
FIG. 6 is a reverse view of the vertical height adjustment mechanism of FIG. 4.
Figure 7:
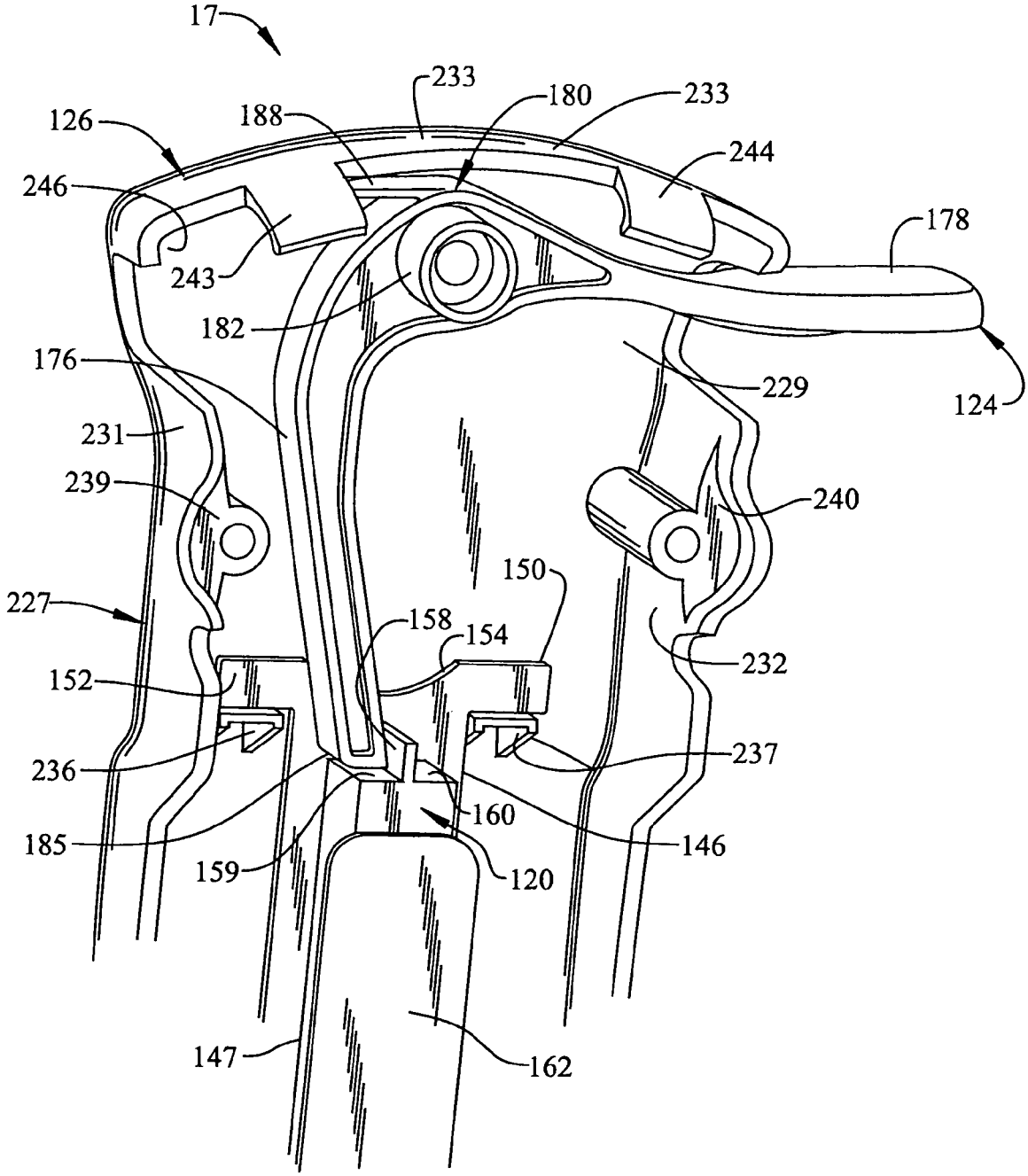
FIG. 7 is a reverse view of the vertical height adjustment mechanism of FIG. 5.

In accordance with a first embodiment of the present invention, slide member 120 is generally T-shaped in cross-section and includes a first end 145 and a second end 146 separated by an intermediate section 147 (FIGS. 6 and 7). In the embodiment shown, an end stop member 150 constituted by a generally-horizontally extending support element 152 is provided at second end 146. Support element 152 includes a semi-circular central rest 154 which, as will be discussed more fully below, engages with latch member 124 when upper dish rack 16 is in the home position. In addition, projecting from second end 146 of slide member 120 is a central, raised tab element 158. Tab element 158 separates or divides second end 146 into first and second support lands 159 and 160 which provide a supporting surface for latch 124 when dish rack 16 is in the second or raised position. Finally, extending along and preferably integrally formed with intermediate section 147 is a sliding surface 162 which contributes to the overall ease of shifting dish rack 16 between the first and second positions.

Latch member 124 includes a support leg 176 that extends to an actuating arm 178 through an intermediate section 180. The ergonomic design of actuation arm 178 provides easy access that enables a user to vertically shift dish rack 16 by simply depressing actuation arm 178 and guiding dish rack down as represented in FIGS. 6 and 7. In the most preferred form of the invention, latch member 124 is pivotal about intermediate section 180 and thus is provided with central pivot hubs 182 and 183 that project substantially perpendicularly outwardly from opposing side surfaces of intermediate section 180. In still further accordance with the most preferred embodiment, support leg 176 terminates in a support surface 185 adapted to engage with first and second support lands 159 and 160 when upper dish rack 16 is in the raised position. More specifically, supporting surface 185 of latch member 124 rests upon either first support land 159 or second support land 160 depending upon the particular orientation, e.g., left or right, of height adjustment mechanism 17. Finally, in order to provide a biasing force to latch member 124, a spring element 188 extends from intermediate section 180 and provides a biasing force that is overcome only upon engagement of actuating arm 178 to deflect latch member 124 and enable dish rack 16 to be lowered from the raised position to the home position.

Figure 4:
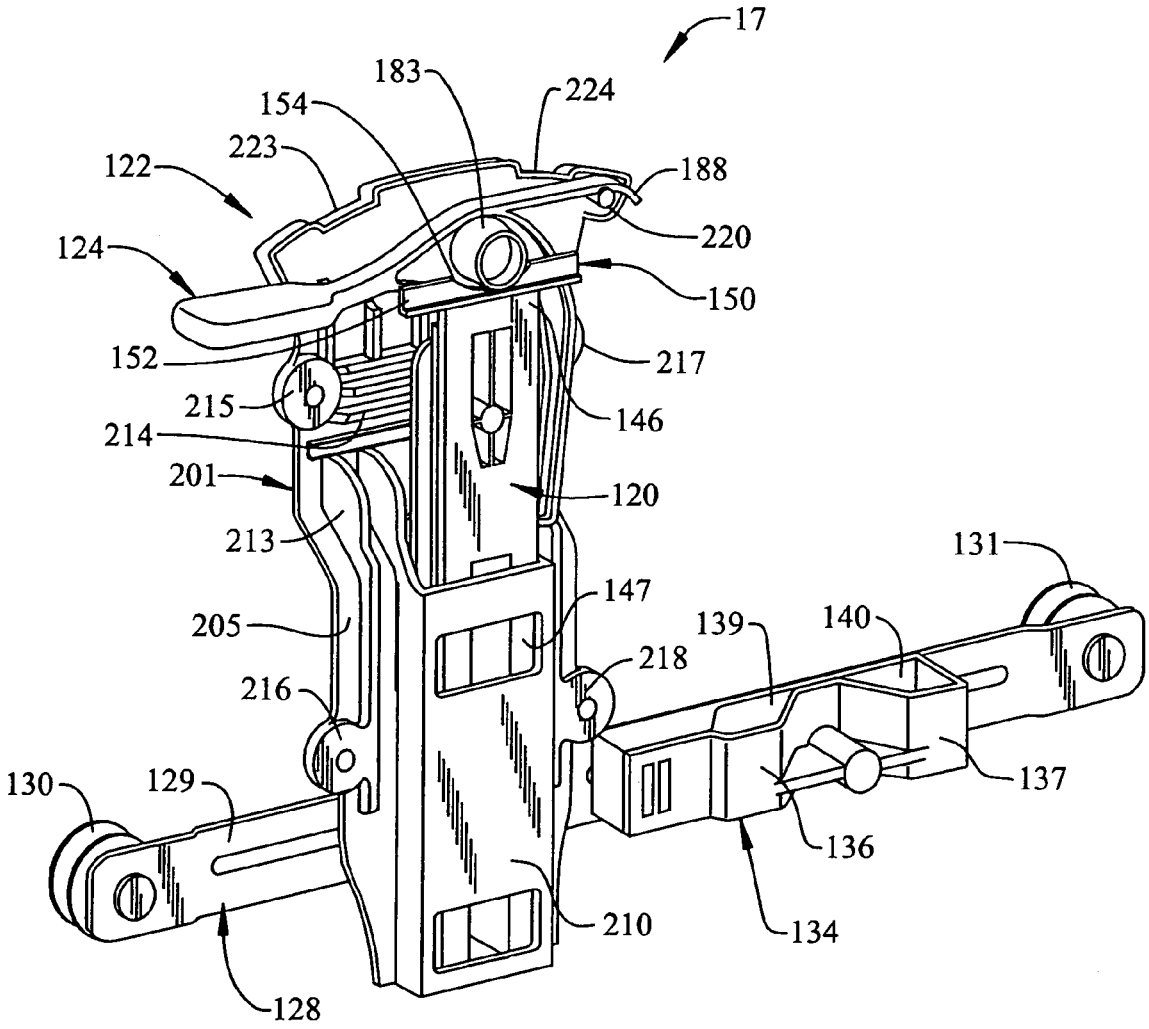
FIG. 4 is a partial perspective view of the vertical height adjustment mechanism of FIG. 2.
Figure 5:
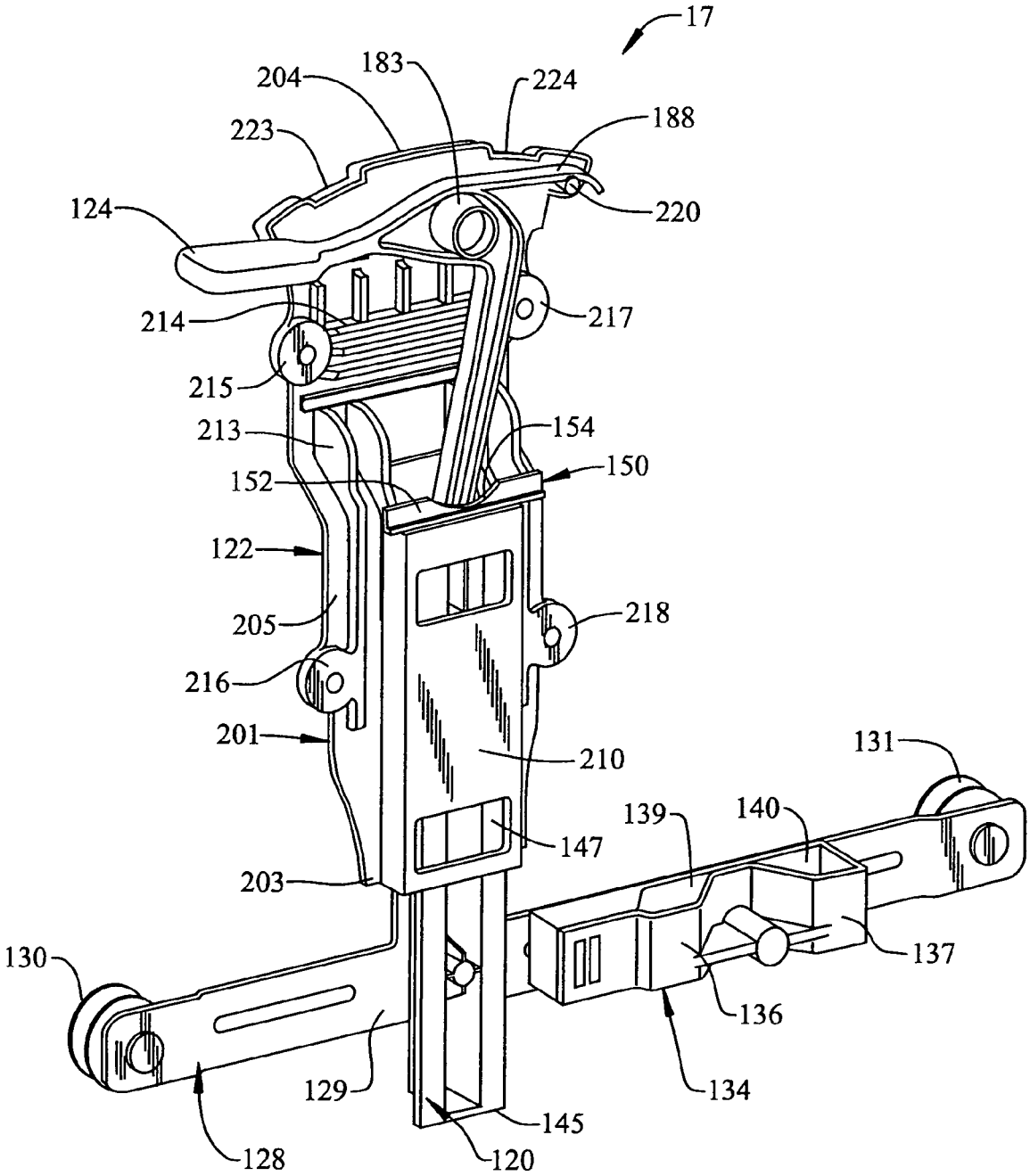
FIG. 5 is a partial perspective view of the vertical height adjustment mechanism of FIG. 3.

As best shown in FIGS. 4 and 5, housing member 122 of height adjustment mechanism 17 includes a main body portion 201 having a first end 203 that leads to a second end 204 through an intermediate surface 205. Formed on intermediate surface 205 is a central guide channel 210 adapted to slidingly receive slide member 120. Preferably, guide channel 210 is sized to snugly fit between two upstanding wire members (not separately labeled) of dish rack 16 to provide a positive engagement for adjustment mechanism 17. Actually, the wire members are received and retained by raised sections, indicated generally at 213, provided on intermediate surface 205. Also arranged on intermediate surface 205 are a plurality of stiffening members, such as those indicated at 214, as well as a plurality of mounting lugs 215-218 for securing housing 122 to dish rack 16, as well as cover 126. Additionally, formed at an outward corner portion of second end 204 is a guide pin 220 adapted to engage and support spring 188 of latch 124. Also formed on second end 204 of housing 122 are first and second recessed portions 223 and 224 that further aid the connectivity of housing 122 to cover 126.

Referring again to FIGS. 6 and 7, cover member 126 includes a main body portion 227 including a main surface portion 229, opposing side edge portions 231 and 232 and a top edge portion 233. In accordance with the most preferred form of the invention, arranged on main surface portion 229 are a pair of travel stops 236 and 237 that are adapted to engage with support element 152 of travel stop 150 (as represented in FIG. 7) to limit the overall extension of dish rack 16. That is, travel stops 236 and 237 prevent dish rack 16 from being raised beyond the second or raised position. Opposing side edge members 231 and 232 have formed thereon mounting lugs 239 and 240 which correspond to mounting and support lugs 215 and 217 of housing 122. Of course it should be noted that an additional pair of mounting lugs (not shown) are also formed on cover 126 that correspond to mounting and support lugs 216 and 218. In order to further aid the connectivity and add to the aesthetics of adjustment mechanism 17 as well as positioning cover 126 with respect to housing 122, top edge 233 is provided with clip elements 243 and 244 which interconnect with recessed portions 223 and 224 of housing 122. In addition, top edge 233 is provided with a down-turned edge member 246 that engages with spring 188 of latch member 124. Finally, cover 126 is provided with a pair of opposing notches 249 and 250 arranged below down-turned portion 246. Notches 249 and 250 provide an opening through which extend actuating arm 178 of latch member 124. Notches 249 and 250 are provided on either side of cover 126 so that cover 126 can be used irrespective of the particular orientation, e.g., left or right of height adjustment mechanism 17.

Figure 8:
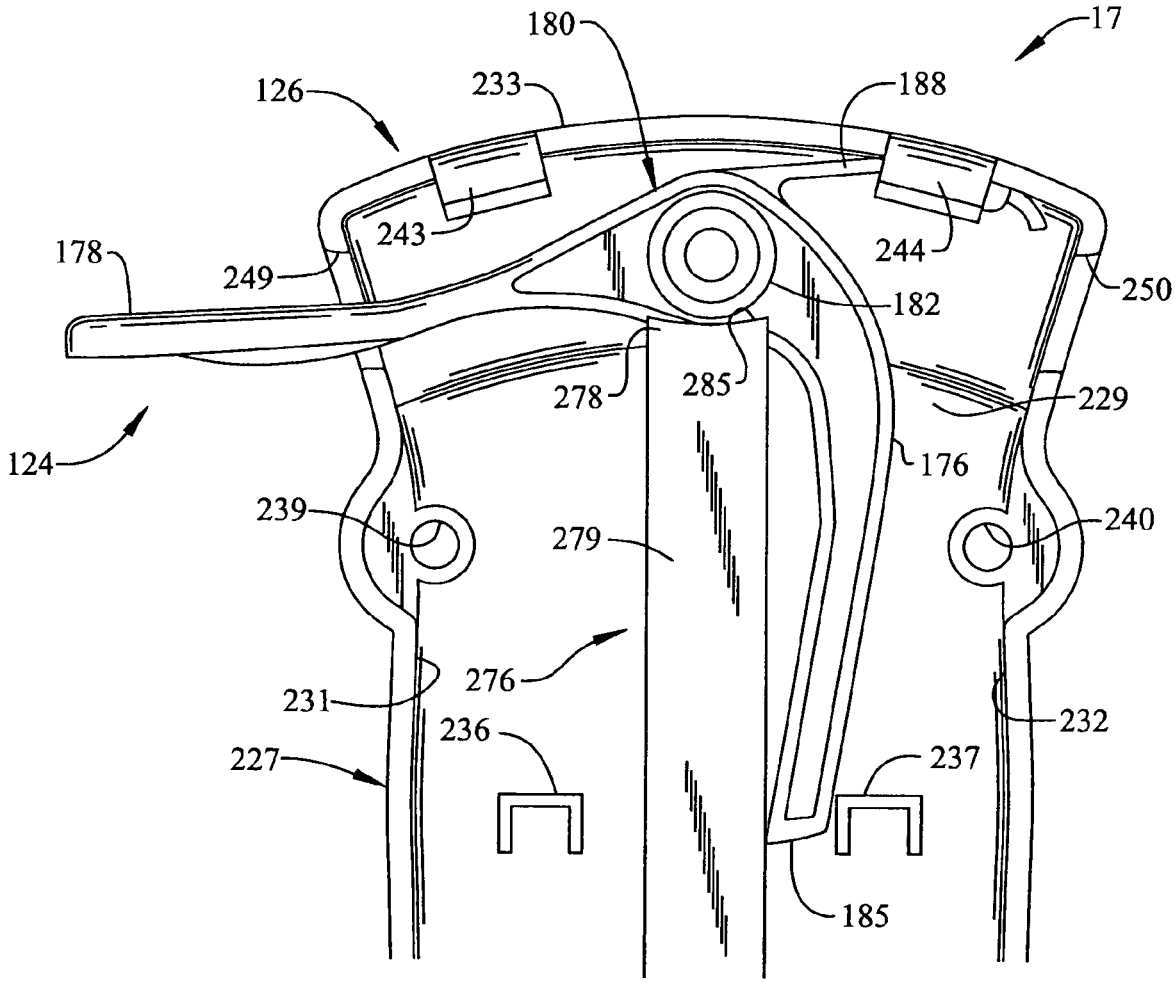
FIG. 8 is a partial elevational view of the vertical height adjustment mechanism constructed in accordance with a second embodiment of the present invention shown with the dish rack in the home position.
Figure 9:
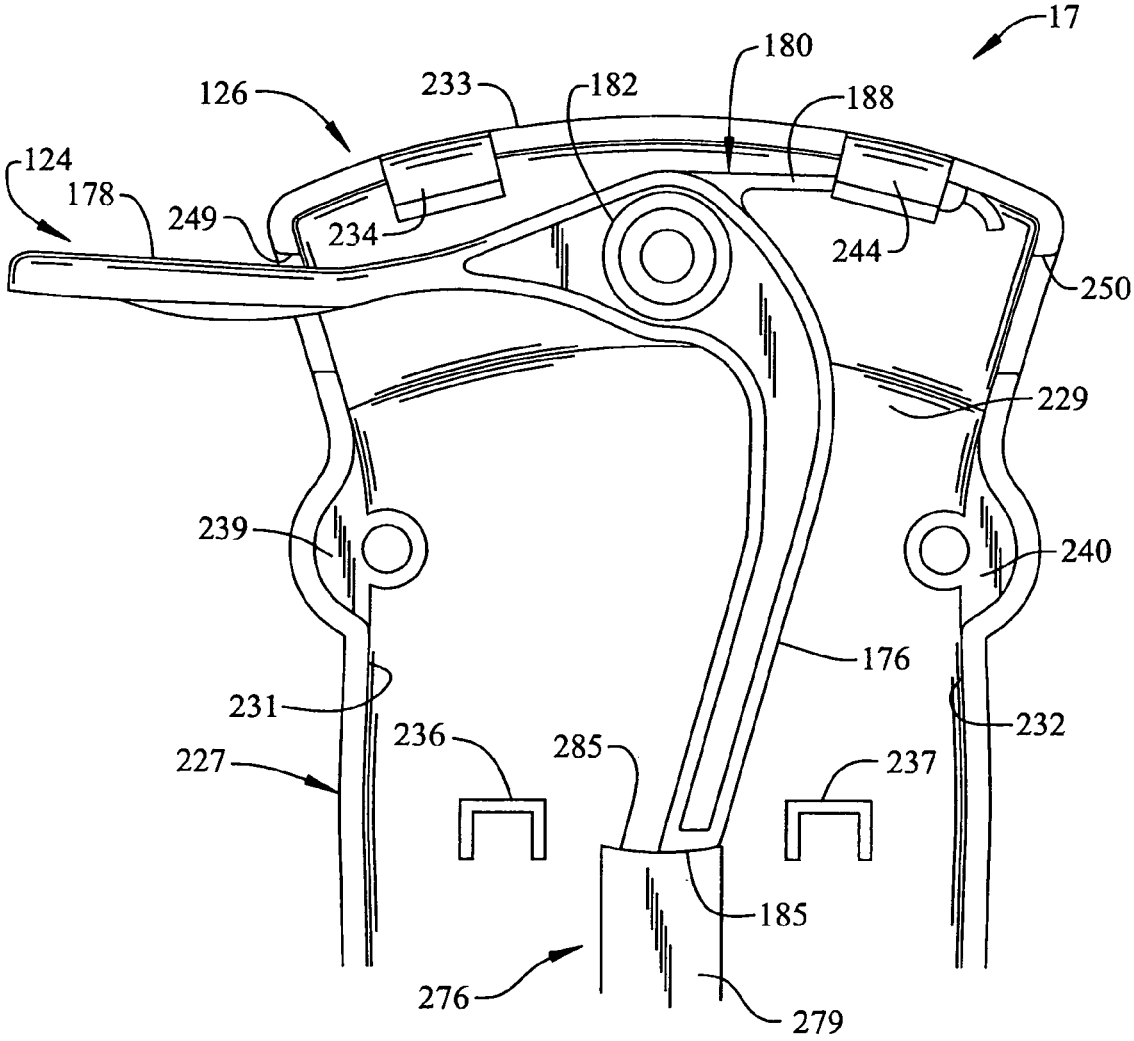
FIG. 9 is a partial elevational view of the vertical height adjustment mechanism constructed in accordance with the second embodiment of the present invention shown with the dish rack in the raised position.

Reference will now be made to FIGS. 8 and 9 in describing a second embodiment of height adjustment mechanism 17. As shown, a slide member 276, constructed in accordance with the second embodiment, includes a first end (not shown) that extends to a second end 278 through an intermediate section 279. Preferably, slide member 276 is formed from a plastic material having a generally rectangular or box-shaped cross-section wherein second end 278 forms a combination support surface/travel stop 285. In accordance with this embodiment, travel stop/supporting surface 285 is concave in shape so as to define a central receiving cup (not separately labeled) extending to opposing raised end sections (also not labeled). Thus, in accordance with the invention, when adjustment mechanism 17 is in a home or lowered position, central pivot hub 182 of latch member 124 rests upon, and is supported by, travel stop 285 and, when adjustment mechanism 17 is in a raised position, support surface 185 of support leg 176 rests on travel stop 285, with the raised end sections preventing latch member 124 from slipping out of engagement, thereby preventing rack 16 from inadvertently falling.

Figure 10:
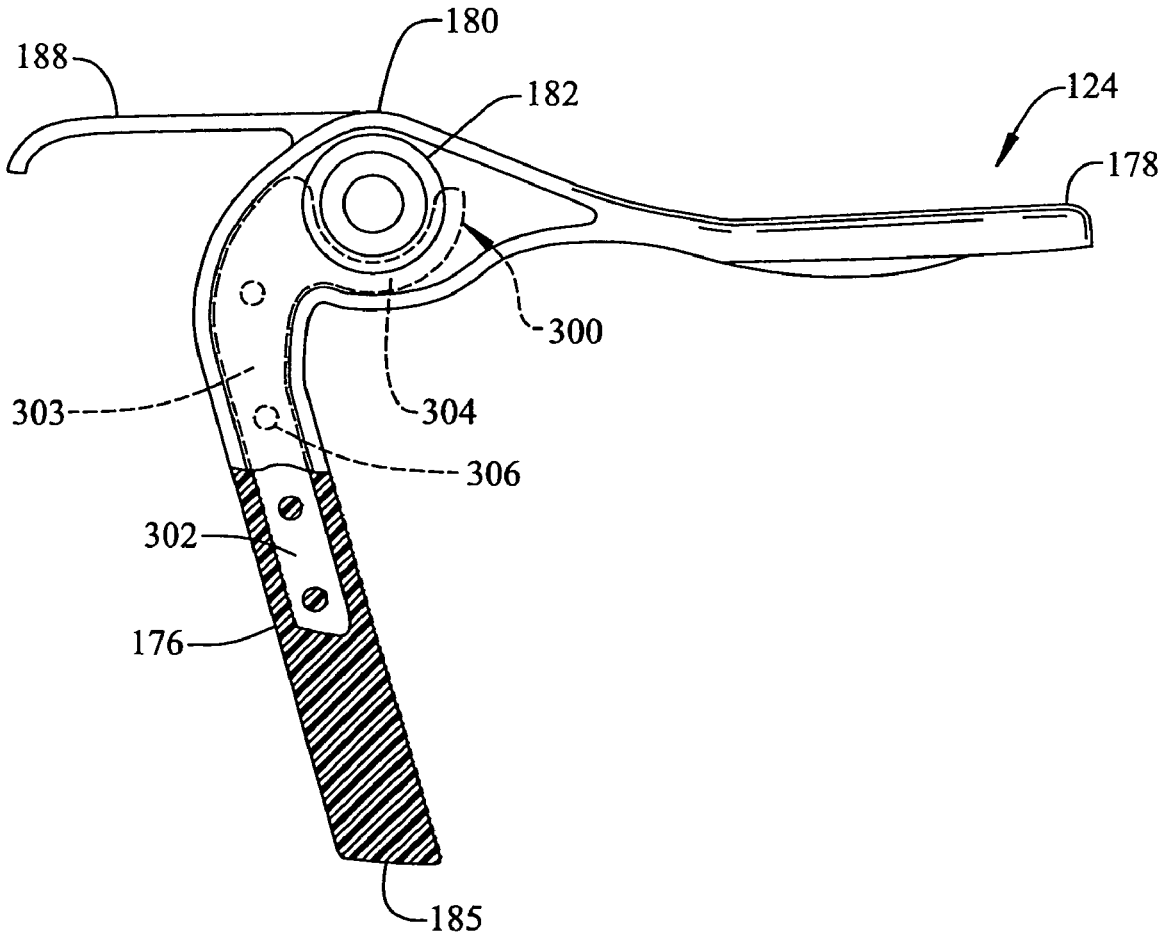
FIG. 10 is a partial, cross-sectional view of a latch member having a metal core constructed in accordance with one form of the present invention.

In further accordance with the present invention, latch member 124 can be constructed in a variety of different forms. For example, as best shown in FIG. 10, latch member 124 preferably includes an integral metal (e.g., steel) core 300. Metal core 300 includes a first segment 302 that extends through a curved portion 303 to a second segment 304. As shown, second segment 304 projects into intermediate portion 180 about central pivot hub 182. In addition, metal core 300 is provided with a plurality of openings, one of which is indicated at 306. With this particular arrangement, latch member 124 is actually formed by over molding metal core 300 with a plastic covering. During the molding process, the plastic covering flows through openings 306 to increase the overall structural integrity and strength of latch member 124, thereby reinforcing and extending an overall service life of height adjustment mechanism 17.

Figure 11:
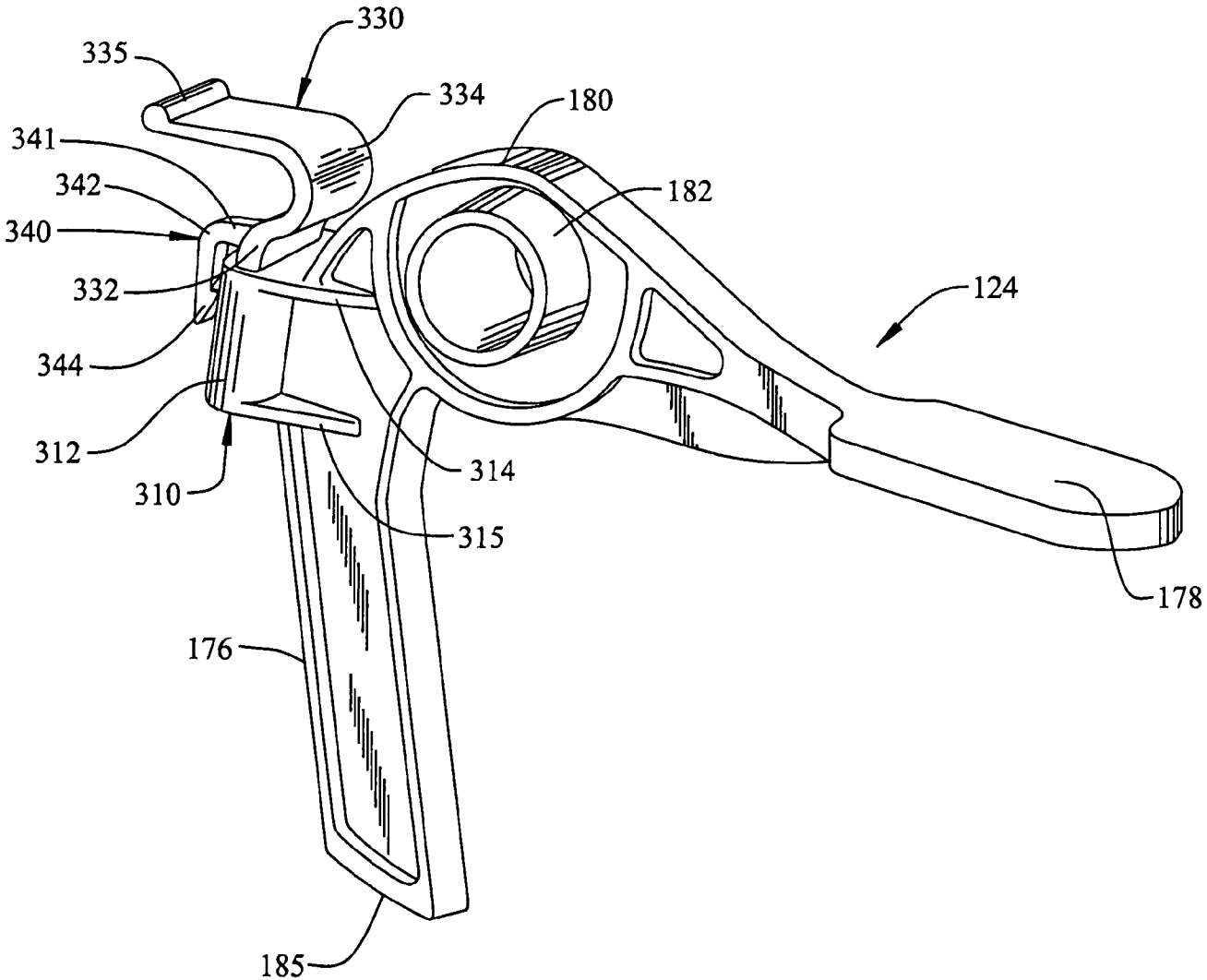
FIG. 11 is a perspective view of a latch member having a detachable spring element constructed in accordance with another form of the present invention.
Figure 12:
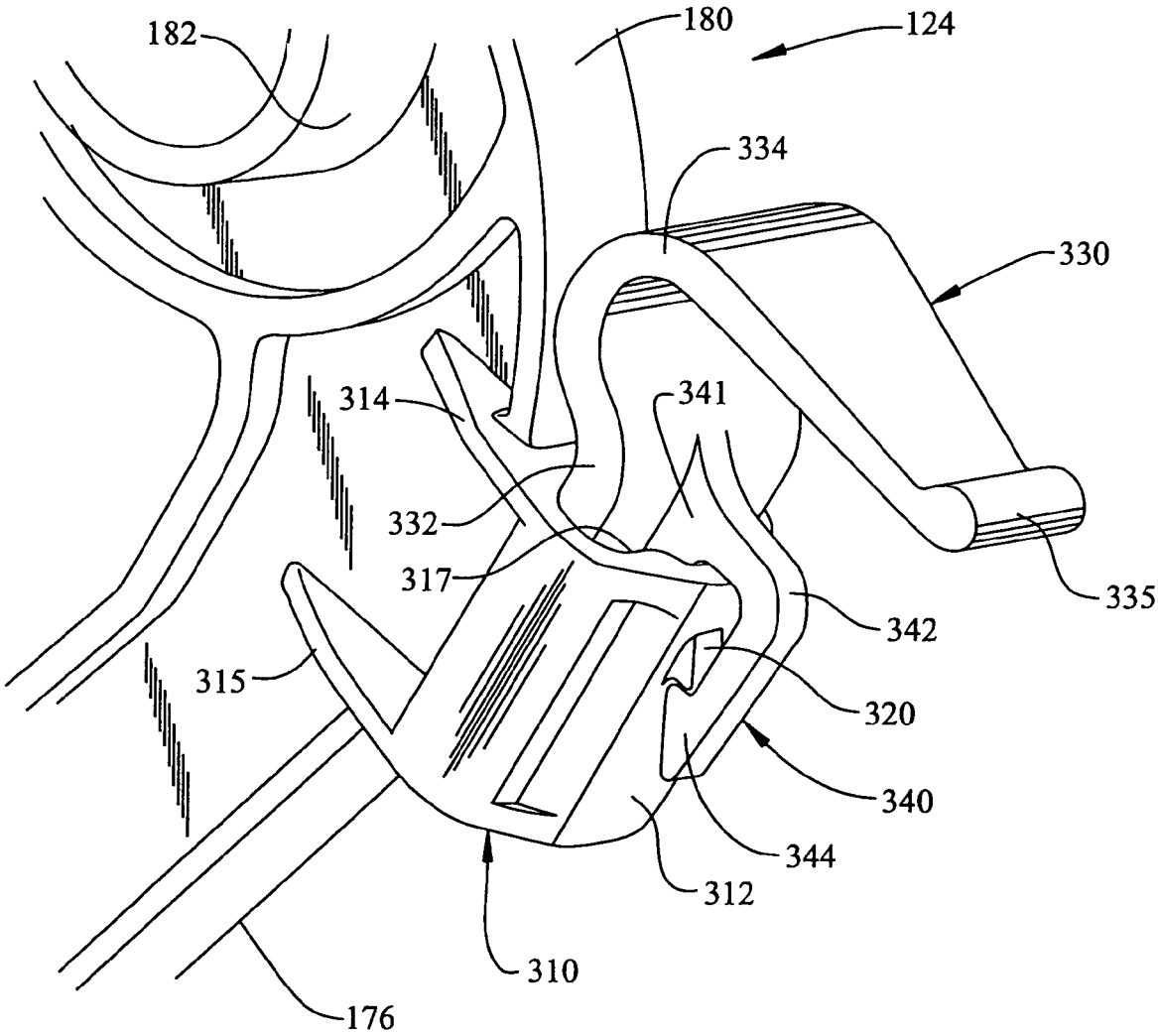
FIG. 12 is a detailed view of the detachable spring element of the latch member of FIG. 1 1.

In another embodiment as represented in FIGS. 11 and 12, latch member 124 includes a mounting bracket 310 integrally formed on an upper portion of support leg 176. As shown, mounting bracket 310 includes a main body portion 312 from which extend upper and lower support struts 314 and 315. In addition, main body portion 312 is provided with a central opening 317 and, as will be discussed more fully below, a tab element 320. With this particular arrangement, a spring member 330 can be inserted into central opening 317 to provide a biasing force to latch member 124. As shown, spring member 330 includes a first end 332 that extends into central opening 317 of mounting bracket 310. In the embodiment shown, first end 332 leads to a curved portion 334 which in turn extends to a cantilevered end portion 335. In a manner similar to that described above with respect to spring member 188, cantilevered end portion 335 engages with down-turned edge member 246 provided on housing 122. In addition, spring member 330 is provided with a clip element 340 adapted to engage with tab element 320. Clip element 340 includes a first portion 341 that extends from first end 332 of spring member 330 and leads to a second portion 342. Second portion 342 extends to, and terminates in, a locking tab, indicated at 344, which is adapted to engage with tab element 320. With this arrangement, spring member 339 can be easily assembled and even replaced if necessary.

Figure 13:
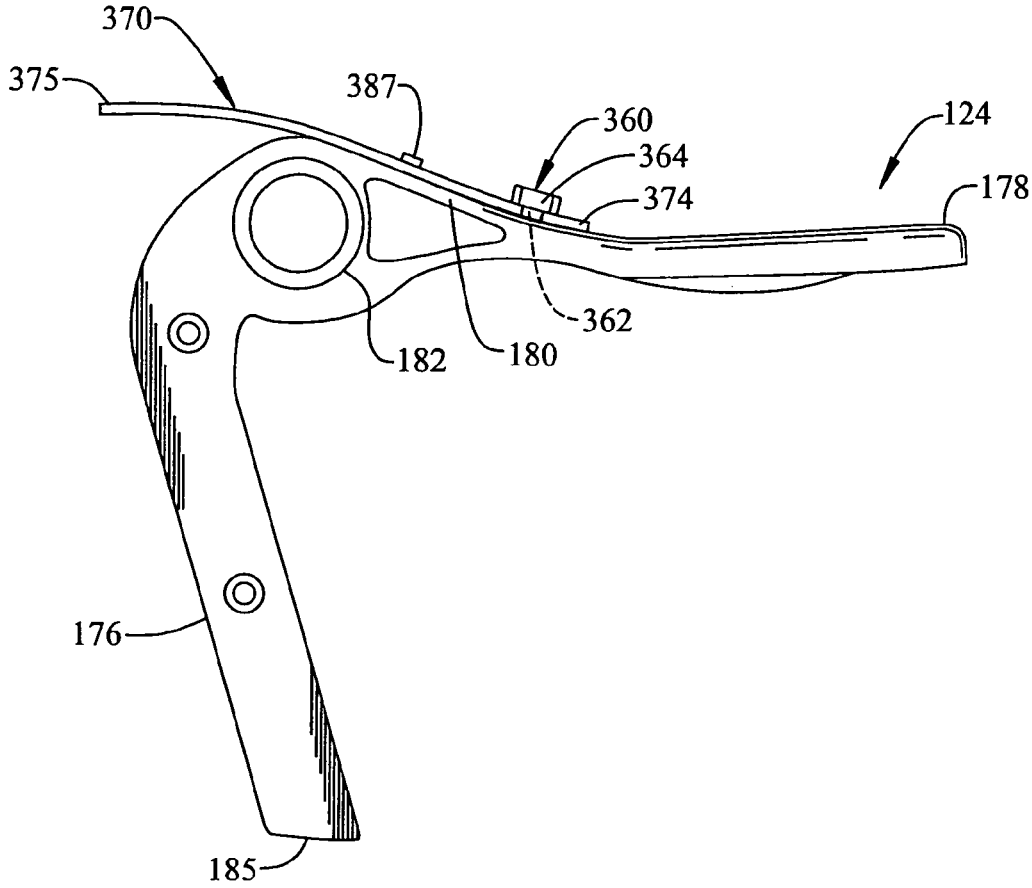
FIG. 13 is a plan view of a latch member having a detachable spring element constructed in accordance with still another form of the present invention.
Figure 14:
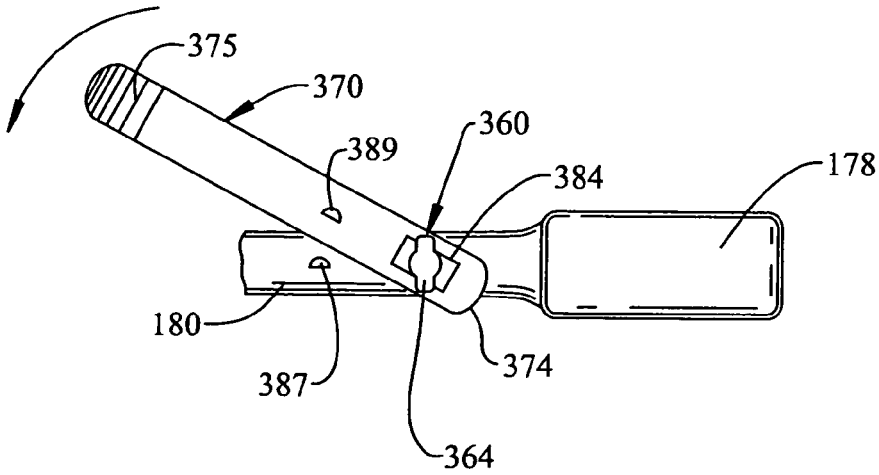
FIG. 14 is a detailed view of a mounting arrangement for the spring element illustrated in FIG. 13.

In accordance with a still further embodiment as illustrated in FIGS. 13 and 14, latch member 124 is provided with a tab 360 that projects upward from intermediate portion 180 proximate to actuating arm 178. Tab 360 exhibits a generally T-shaped cross-section that includes a base or stem portion 362 and a head portion 364. With this particular arrangement, a spring element 370 can be detachably secured to latch member 124. In the embodiment shown, spring element 370 is formed from spring steel and includes a first end 374 and a second, cantilevered end 375, between which is a bent portion (not separately labeled) that conforms to the shape of latch member 124. Second cantilevered end 375 can be biased against a pin, such as illustrated in FIG. 5, or other such structure provided on a cover (not shown). First end 374 is provided with a generally rectangular opening 384 that is sized to receive head portion 364 of tab 360. In this manner, spring element 370 can be placed over tab 360 such that head portion 364 passes through opening 384. At this point, spring element 370 can be rotated, as represented in FIG. 14, through approximately 90° to the position represented in FIG. 13. In accordance with one aspect of the present embodiment, latch member 124 is also provided with a locating element 387 positioned adjacent to tab 360. Locating element 387 includes a semi-circular profile that is adapted to cooperate with an opening 389 having a corresponding shape provided in spring element 370. Locating element 387 ensures proper orientation and position of spring element 370 on latch member 124. In this particular form of the invention, a relatively simple, yet wear-resistant spring is formed for latch member 124 that, if needed, can also be easily replaced.

Figure 15:
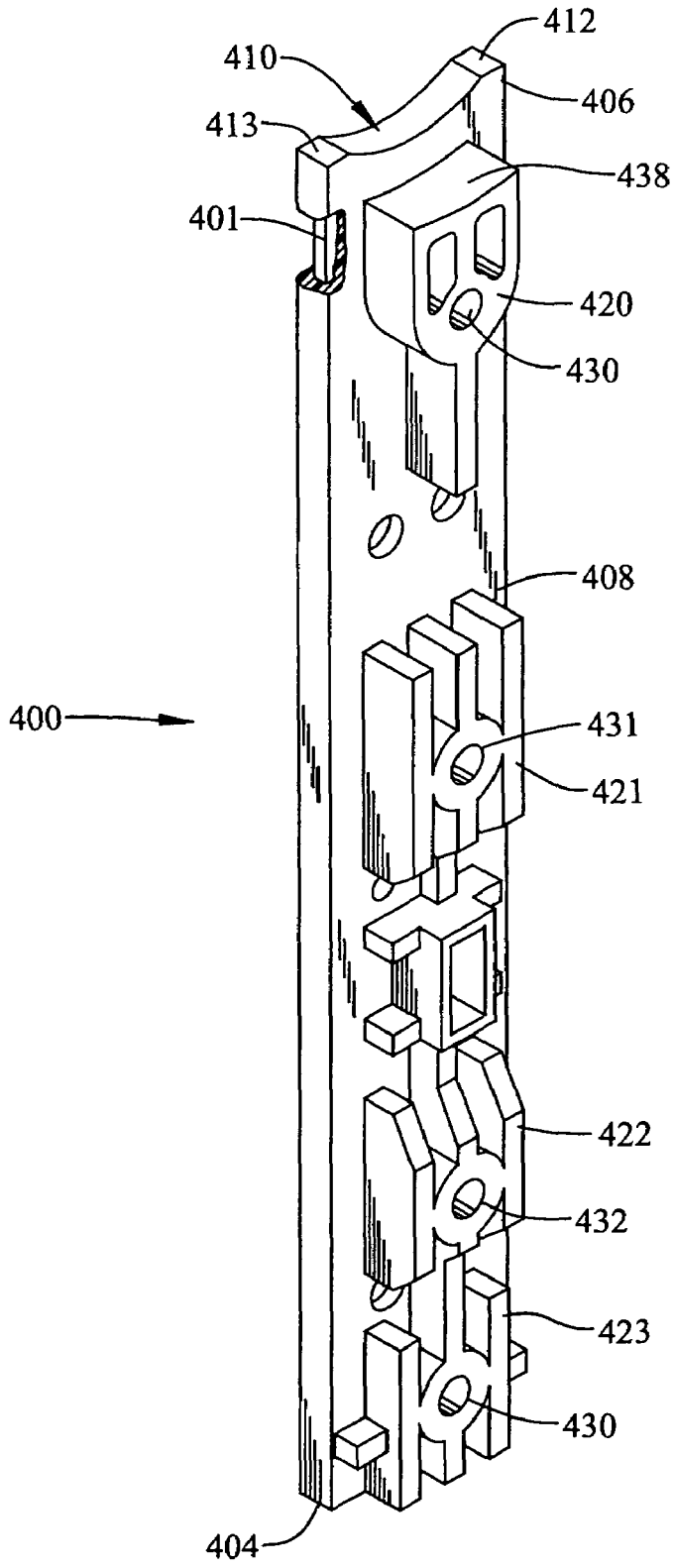
FIG. 15 is a partially cross-sectioned, perspective view of a slide member including an integral metal core constructed in accordance with an aspect of the present invention.

Reference will now be made to FIG. 15 in describing yet another aspect of the present invention. In order to further extend service life, height adjustment mechanism 17 includes a slide member 400 having a metal (e.g., steel) core 401. In a manner similar to that described above with respect to slide member 276, slide member 400 includes a first end 404 that extends to a second end 406 through an intermediate portion 408. Second end 406 defines a support surface 410 having first and second raised sections 412 and 413 that cooperate with, for example, pivot hub 182 to prevent latch member 124 from slipping from support surface 410 when dish rack 16 is in the lowered position. As shown, intermediate portion 408 is provided with a plurality of raised sections 420-423. Each raised section 420-423 is provided with a corresponding opening 430-433 for receiving a respective mechanical fastener (not shown) to secure slide member 400 to wheeled base member 128. In addition, raised portion 420 includes a support portion 438 that engages with support surface 185 of latch member 124 when dish rack 16 is moved to the raised position.

At this point, it should be understood that, while slide member 400 appears similar to slide member 276, slide member 120 could also be provided with a metal core. In any event, metal core 401 is over-molded with a plastic coating. Preferably, the plastic coating is constituted by TEFLON filled NORYL. NORYL is employed as it possesses a low coefficient of friction. However, NORYL does not possess a high creep strength. Thus, to assure the overall structural stability of slide member 400, as well as to prevent the plastic coating from changing shape at elevated temperatures, metal core 401 is employed to increase the overall strength of support member 400.

Figure 16:
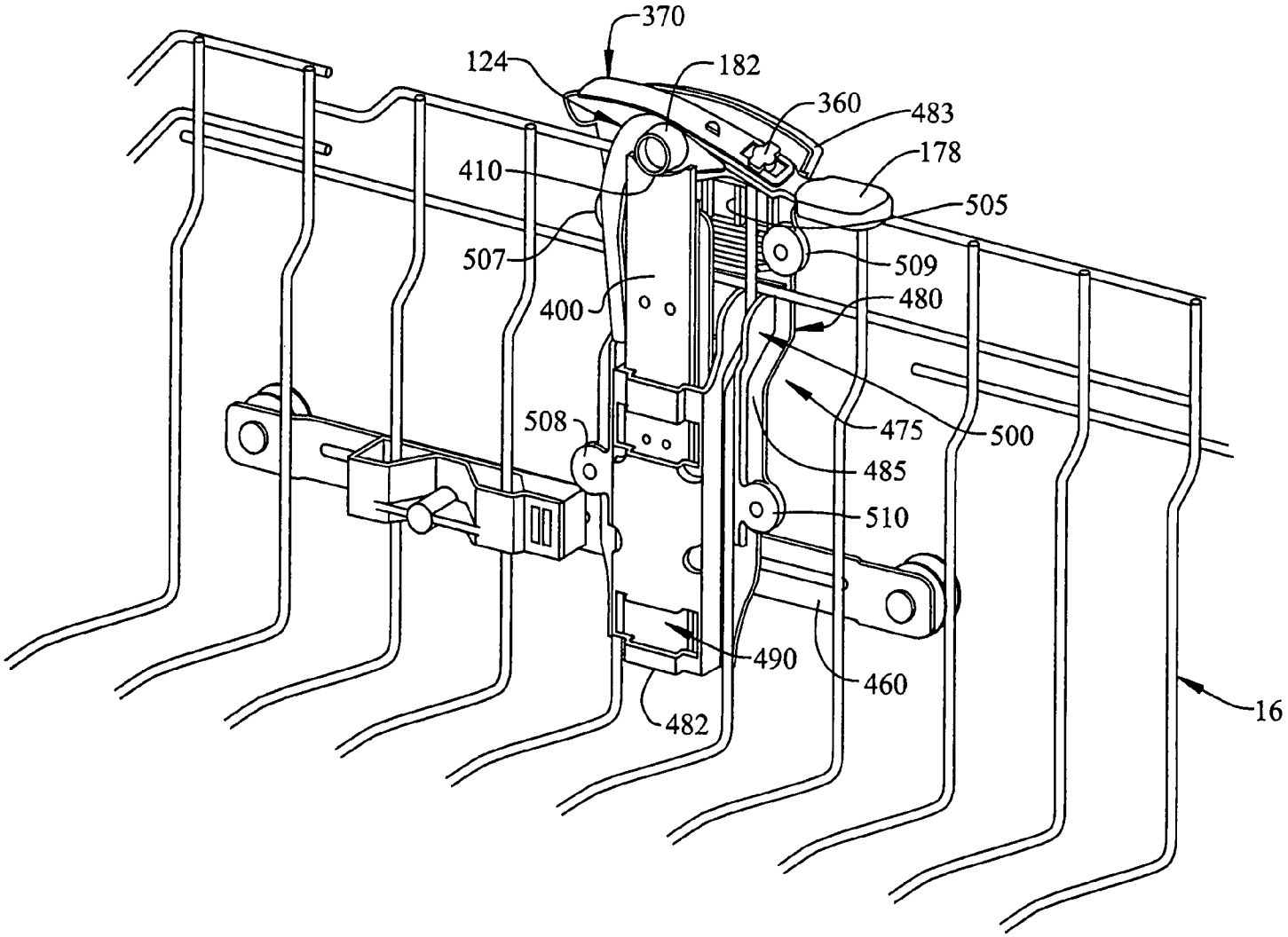
FIG. 16 is a partial perspective view of a vertical height adjustment mechanism incorporating the slide member of FIG. 15.

As best shown in FIG. 16, slide member 400 is secured to a strut member 460 through a housing 475 in a manner similar to that described above. Housing 475 includes a main body portion 480 having a first end 482 that leads to a second end 483 through an intermediate section 485. A central guide channel 490 is established along intermediate section 485, with guide channel 490 being sized to extend between two upstanding wire members (not separately labeled) of dish rack 16. Actually, the wire members are retained by raised sections, indicated generally at 500, provided on intermediate section 485 to establish a positive engagement for the overall adjuster mechanism 17. Also arranged on intermediate section 485 are a plurality of stiffening members, one of which is indicated at 505, as well as a plurality of mounting lugs 507-510 for securing a cover (not shown). With this construction, slide member 400 can ride within guide channel 490 as rack 16 is transitioned between raised and lowered positions.

With this overall construction, it should be readily apparent that height adjustment mechanism 17 provides a simple, cost-effective means of selectively increasing the defined vertical spacing between upper and lower dish racks in a dishwasher. More specifically, as height adjustment mechanism 17 is formed from components that are adaptable to be placed in either orientation, e.g., left or right side of the dish rack, the overall cost of manufacturing, that is the need to produce different parts for different sides of the dish rack, is eliminated. In addition, the particular manner in which height adjustment mechanism 17 interacts with the dish rack provides for a smooth and easy transition between the lower and raised positions and further provides a stable foundation in the raised position so that the height adjustment mechanism does not become a limiting factor in the amount of dishware capable of being placed in the dish rack when in the raised position. Height adjustment mechanism 17 constructed in accordance with the present invention provides a simple, easy to operate, stable device that enables a user to vertically shift a dish rack.

Although described with reference to preferred embodiments of the present invention, it should be readily apparent to one of ordinary skill in the art that various changes and/or modifications can be made to the invention without departing from the spirit thereof. For instance, the reinforcing structure defined by core 300 and/or 401 could be made of a material other than metal. In addition, while shown with reference to height adjustment mechanism 17 being located on a left side of dish rack 16, a second, opposing height adjustment mechanism is provided on the right side. It should also be noted that, if the dishwasher includes three dish racks, more than one rack could be provided with vertical adjustment capabilities. In general, the invention is only intended to be limited by the scope of the following claims.

We claim:

1. A dishwasher comprising:

a tub having integral top, bottom, rear and side walls that collectively define a washing chamber;

a door pivotally mounted relative to the tub, said door being adapted to selectively close the washing chamber;

at least one support member mounted to the side wall of the tub, said at least one support member being shiftable between a first position wherein the at least one support member is entirely within the washing chamber and a second position wherein a portion of the at least one support member extends from the washing chamber;

a dish rack supported by the at least one support member for movement into and out of the washing chamber; and an adjustment mechanism for vertically shifting the dish rack between a lowered position and a raised position relative to the at least one support member, said adjustment mechanism including:

a slide member including a first end attached to the support member, a second end with a support surface, and an intermediate section;

a housing secured to the dish rack, said housing including a guide channel slidably receiving the slide member; and a latch member including a support leg, an actuating arm and an intermediate portion joining the support leg to the actuating arm, said latch member being pivotally mounted relative to the housing at the intermediate portion, said support leg engaging the second end of the slide member to maintain the dish rack in the raised position, and the intermediate portion of the latch member engaging the support surface on the second end of the slide member when the dish rack is in the lowered position;

wherein shifting of the dish rack from the raised position to the lowered position requires actuation of the latch member, while shifting the dish rack from the lowered position to the raised position does not require actuation of the latch member.

2. The dishwasher according to claim 1, wherein the latch member also includes a spring member, said spring member engaging the housing to provide a biasing force to the latch member.

3. The dishwasher according to claim 2, wherein the latch member includes a metal core, said metal core being over molded with a plastic covering.

4. The dishwasher according to claim 3, wherein the metal core includes a first segment that extends along the support leg and a second segment that extends along a section of the intermediate portion.

5. The dishwasher according to claim 2, wherein the latch member further includes a mounting bracket, said spring member being retained by the mounting bracket.

6. The dishwasher according to claim 5, wherein the mounting bracket includes a tab element and the spring member includes a clip element, said clip element engaging the tab element to attach the spring member to the mounting bracket.

7. The dishwasher according to claim 2, wherein the latch member includes a tab protruding from the intermediate portion, said tab being engaged by the spring element.

8. The dishwasher according to claim 7, wherein the tab has a generally T-shaped cross-section.

9. The dishwasher according to claim 7, wherein the spring element includes a first end provided with an aperture and a second end, said first end being mounted to the tab and the second end being cantilevered.

10. The dishwasher according to claim 9, wherein the latch member includes a locating element arranged adjacent to the aperture for locating the spring element relative to the latch member.

11. The dishwasher according to claim 1, wherein the first end of the slide member is fixedly mounted to the support member.

12. The dishwasher according to claim 11, wherein the second end of the slide member includes an end stop adapted to engage with the latch member when the dish rack is in the lowered position.

13. The dishwasher according to claim 12, wherein the end stop defines a generally arcuate rest portion.

14. The dishwasher according to claim 13, wherein the latch member includes at least one generally cylindrical pivot hub adapted to seat in the rest portion of the end stop when the dish rack is in the lowered position.

15. The dishwasher according to claim 11, wherein the intermediate section is generally T-shaped in cross-section and said second end includes a central raised tab element separating two supporting lands.

16. The dishwasher according to claim 15, wherein the intermediate section includes a sliding surface adapted to ride within the guide channel.

17. The dishwasher according to claim 15, wherein the support leg of the support member rests upon one of the two supporting lands when the dish rack is in the raised position.

18. The dishwasher according to claim 11, wherein the slide member is box-shaped in cross-section, with the second end including a concave surface defining a support cup.

19. The dishwasher according to claim 18, wherein the slide member includes a metal core.

20. The dishwasher according to claim 18, wherein the support leg of the support member rests within the support cup when the dish rack is in the raised position.

21. The dishwasher according to claim 11, wherein the second end includes a travel stop provided on the housing, said slide member being adapted to engage the travel stop to limit movement of the dish rack beyond the raised position.

22. The dishwasher according to claim 11, wherein the at least one support member includes a wheeled base member.

23. The dishwasher according to claim 22, wherein the first end of the slide member is secured to the wheeled base member.

24. The dishwasher according to claim 22, further comprising: a stabilizer member secured to the wheeled base member, said stabilizer member being adapted to partially guide the dish rack between the lowered position and the raised position.

25. The dishwasher according to claim 24, wherein the stabilizer member includes at least one guide element, said dish rack being formed from a plurality of wire members with at least one of the plurality of wire members being received by the at least one guide element.

26. The dishwasher according to claim 11, wherein the housing includes a main body portion extending to a top portion, said main body portion having integrally formed therewith the guide channel, said top portion pivotally supporting the latch member.

27. The dishwasher according to claim 26, wherein the adjustment mechanism includes a cover member detachably secured to the housing.

28. The dishwasher according to claim 27, wherein the cover member includes a clip element, said cover member being detachably secured to the top portion of the housing through the clip element.

29. The dishwasher according to claim 27, wherein the cover member is detachably secured to the housing through a plurality of mechanical fasteners.

30. The dishwasher according to claim 27, wherein the cover member includes at least one travel stop, said travel stop being adapted to engage with the second end of the slide member to prevent the dish rack from being lifted significantly beyond the raised position.

31. A method of vertically shifting a dish rack carried by at least one support member for movement into and out of a washing chamber of a dishwasher comprising:

guiding a dish rack along a slide member attached to the at least one support member to raise the dish rack from a lowered position to a raised position;

resting a support leg of a latch member attached to the dish rack on the slide member to maintain the dish rack in the raised position;

shifting an actuation arm portion of the latch member against a biasing force of a spring to deflect the support leg of the latch member away from the slide member;

guiding the dish rack along the slide member to shift the dish rack from the raised position back to the lowered position; and supporting an intermediate portion of the latch member on the slide member when the dish rack is in the lowered position.

32. The method of claim 31, further comprising: positioning the support leg on an arcuate surface formed on an end portion of the slide member when the dish rack is in the raised position.

33. The method of claim 31, further comprising: pivoting the latch member about a hub positioned between the support leg and the actuation arm.

34. The method of claim 31, further comprising: limiting upward movement of the dish rack by engaging a travel stop, provided for movement with the dish rack, with the slide member.

35. The method of claim 34, further comprising: supporting the dish rack on an end stop of the slide member when the dish rack is in the lowered position.

* * * * *